United States Patent [19]

Buschulte et al.

[11] 4,318,688

[45] Mar. 9, 1982

[54] OIL BURNER

[75] Inventors: Winfried Buschulte, Celle; Friedhelm Dageforde, Munster-Trauen, both of Fed. Rep. of Germany

[73] Assignee: Deutsche Forschungs- und Versuchsanstalt fur Luft- und Raumfahrt e.V., Linder Hohe, Fed. Rep. of Germany

[21] Appl. No.: 70,794

[22] Filed: Aug. 29, 1979

[30] Foreign Application Priority Data

May 8, 1979 [DE] Fed. Rep. of Germany ..... 2918416

[51] Int. Cl.[3] ..... F23D 11/40

[52] U.S. Cl. ..... 431/114; 431/116; 431/265; 431/352

[58] Field of Search ..... 431/114, 115, 116, 265, 431/352, 353, 9

[56] References Cited

U.S. PATENT DOCUMENTS

| | | | |
|---|---|---|---|
| 2,857,961 | 10/1958 | Brown et al. | 431/116 |
| 3,269,448 | 8/1966 | Martin | 431/116 |
| 3,510,238 | 5/1970 | Biber | 431/116 |
| 3,545,902 | 12/1970 | Bailey | 431/116 |
| 3,589,848 | 6/1971 | Potts | 431/116 |
| 3,620,657 | 11/1971 | Robinson | 431/116 |

FOREIGN PATENT DOCUMENTS

| | | | |
|---|---|---|---|
| 2751524 | 5/1979 | Fed. Rep. of Germany | 431/116 |

*Primary Examiner*—Samuel Scott
*Assistant Examiner*—Lee E. Barrett
*Attorney, Agent, or Firm*—Salter & Michaelson

[57] ABSTRACT

An oil burner including an oil atomizing nozzle to be mounted upstream of a transverse wall in a cylindrical flame tube and to discharge oil through an aperture in the wall through which air also passes into a cylindrical mixing tube positioned co-axially within the flame tube and open at its downstream end. The flame tube has a length at least twice its diameter and a diameter between 2.0 and 2.5 times the diameter of the mixing tube. At least one passage adjacent the transverse wall communicates between the interior of the flame tube and the interior of the mixing tube to recirculate combustion gases from the downstream end of the mixing tube to the upstream end thereof. The peripheral wall of the mixing tube adjacent its downstream end is perforated.

8 Claims, 6 Drawing Figures

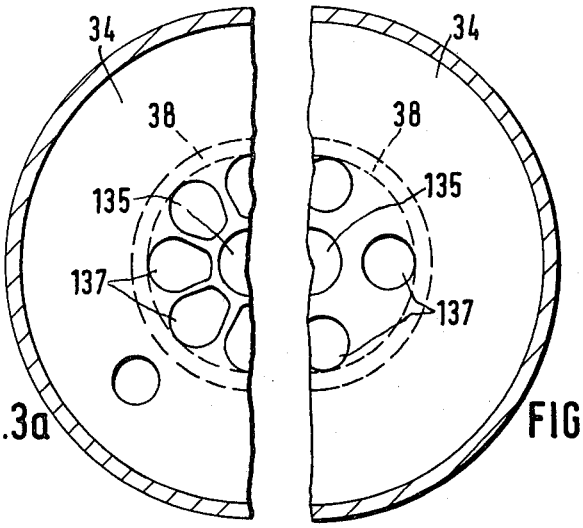
FIG.3a FIG.3b
FIG.3
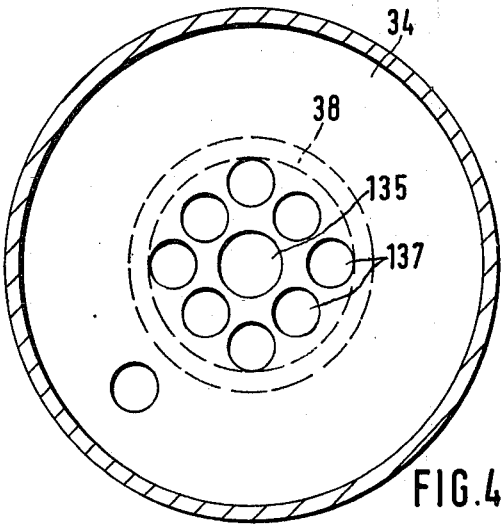
FIG.4

OIL BURNER

BACKGROUND OF THE INVENTION

The invention relates to an oil burner of the type having an oil atomising device, a wall containing at least one aperture and arranged downstream of the outlet of the oil atomising device, a flame tube extending from the wall in the downstream direction, a mixing tube positioned co-axially within the flame tube downstream from and co-axial with the aperture, and a passage adjacent the wall and communicating between the interior of the mixing tube and the interior of the flame tube.

Oil burners of this type have the advantage that complete, stoichiometric combustion, free of soot, can be achieved, and that optimum combustion is largely independent of the size of the chamber of a boiler in which the burner is fitted. Experience has shown that the emission of noise is dependent on the design of the chamber and/or the burner. The reduction of noise emission is particularly important in domestic heating installations.

An object of the invention is to reduce the noise emission by or associated with an oil burner of the foregoing type.

SUMMARY OF THE INVENTION

According to the invention, an oil burner comprises a chamber, an oil atomising device supported in said chamber, an air supply duct connected to said chamber and through which duct air is delivered to said chamber, a wall extending transversely of said chamber and positioned downstream of said atomising device, said wall having therein at least one aperture through which air and oil from said atomising device are discharged from said chamber, a substantially cylindrical flame tube extending from said wall in the downstream direction, a mixing tube positioned co-axially within said flame tube downstream from and co-axial with the aperture in said wall, said mixing tube having a portion of its peripheral wall at least adjacent its downstream end thereof perforated, said flame tube having a length at least twice the diameter thereof and a diameter between substantially 2.0 and 2.5 times the diameter of said perforated portion of said mixing tube, and at least one passage adjacent said wall, and extending between the annular space between said flame tube and said mixing tube and the interior of said mixing tube.

The upstream end of said mixing tube may be spaced from said transverse wall to define said passage, said mixing tube having a portion of its peripheral wall adjacent the upstream end thereof unperforated, the unperforated portion extending axially of said mixing tube for a length which is less than two thirds of the diameter of said perforated portion of said mixing tube. Alternatively, said mixing tube may extend from said transverse wall in the downstream direction and have a portion of its peripheral wall adjacent said transverse wall perforated to define a plurality of passages extending from the annular space between said flame tube and said mixing tube into the interior of said mixing tube, the mixing tube having a further portion of its peripheral wall adjacent to and downstream from said portion adjacent said transverse wall unperforated, said further portion extending axially of said mixing tube for a length which is less than two thirds of the diameter of said perforated portion of said mixing tube.

The aperture in said transverse wall may be formed by a plurality of smaller separate air openings arranged in a circle around a central opening, said circle of openings positioned within an upstream projection of the internal cross-section of said mixing tube on said transverse wall.

BRIEF DESCRIPTION OF THE DRAWINGS

By way of example, several embodiments of an oil burner in accordance with the invention are now described with reference to the accompanying drawings, in which:

FIGS. 3 and 4 are sections corresponding to a section on the line III—III in FIG. 1 and show alternative arrangements of oil and air inlets differing from those shown in FIGS. 1 and 2, FIGS. 3*a* and 3*b* showing two different shapes of inlet, one at each side of a vertical centre line.

DESCRIPTION OF THE PREFERRED EMBODIMENTS

Figure 1:
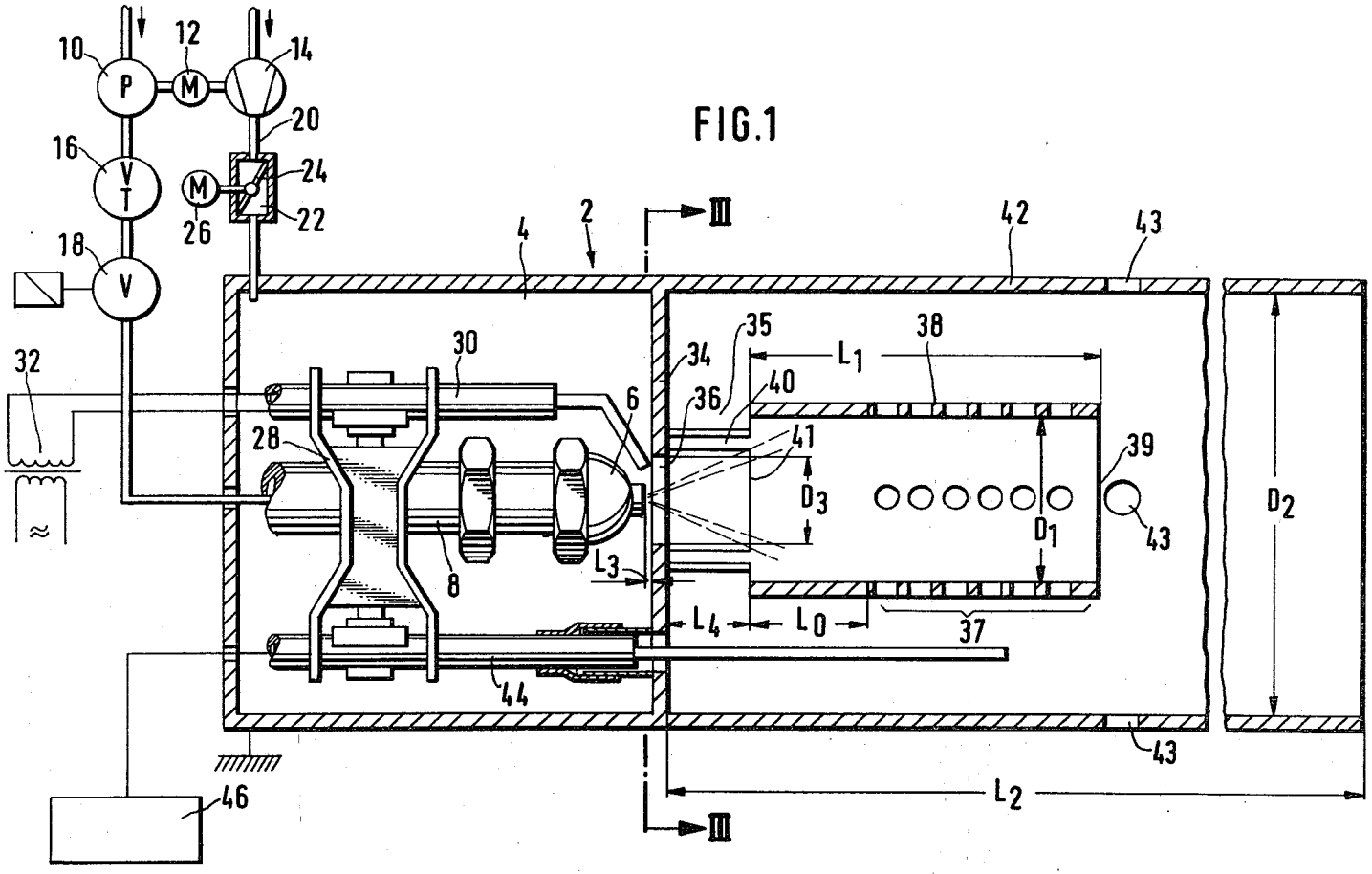
FIG. 1 is a schematic longitudinal section of one embodiment of an oil burner.
Figure 2:
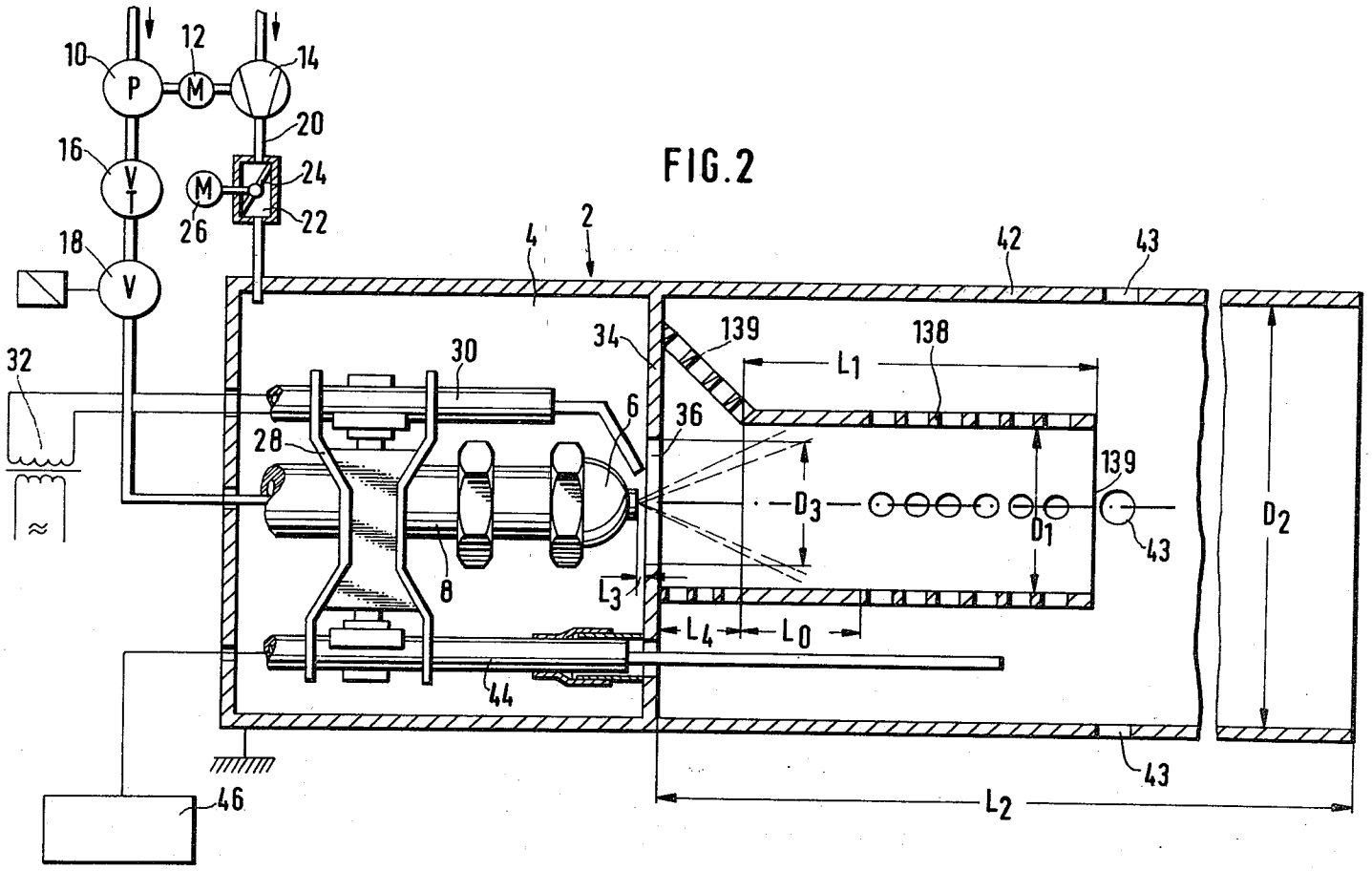
FIG. 2 is a schematic longitudinal section similar to FIG. 1 of another embodiment of an oil burner and showing two forms of a mixing tube, one above and the other below a horizontal centre line.

The burner 2, shown in FIGS. 1 and 2, defines a chamber 4 in which a pressure-atomising nozzle 6 is supported by a nozzle connection 8. Oil is delivered to the nozzle connection 8 by an oil pump 10 which is driven by an electric motor 12 which also drives a rotor 14 of a blower. The pump 10 delivers the oil through an adjustable butterfly valve 16 and an electromagnetically-actuated shut-off valve 18 into the nozzle connection 8 and the atomizing nozzle 6. The blower 14 delivers air through a duct 20 into the chamber 4 through a butterfly valve 22 having a flap 24 which is adjustable by a motor 26. A support 28 is mounted on the nozzle connection 8 and carries a pair of electrodes 30 which are connected to an ignition transformer 32. A wall 34, extending transversely of the chamber 4 and having an aperture 36, is positioned at a distance $L_3$ downstream from the mouth of the atomizing nozzle 6. The aperture 36 is circular in cross-section and co-axial with the atomising nozzle 6. Downstream from and co-axial with the aperture 36 there is a mixing tube 38 (FIG. 1) or 138 (FIG. 2) which is integral with or secured to the wall 34. The mixing tube 38 or 138 is co-axial within a substantially cylindrical flame tube 42 of which the upstream end is integral with or is secured in an air-tight manner to the wall 34.

In FIG. 1, the mixing tube 38 is attached to the wall 34 by supporting bars 40, whereby the upstream end 41 of the mixing tube 38 is spaced by a distance $L_4$ from the wall 34. The space between the upstream end 41 of the mixing tube 38 and the wall 34 defines a passage 35 which provides communication from the space between the flame tube 42 and the mixing tube 38 into the interior of the mixing tube 38. Combustion gases downstream of the mixing tube 38 recirculate between the flame tube 42 and the mixing tube 38, through the passage 35, into the mixing tube 38.

In FIG. 2, the upstream end of the two illustrated forms of mixing tube 138 abut the wall 34 and are secured to or are integral with the wall 34. Recirculation of combustion gases in FIG. 2 is provided for by perforations in an upstream portion of the peripheral wall of each form of mixing tube 138, as will be described hereinafter.

Referring again to FIGS. 1 and 2, the diameter $D_2$ of the flame tube 42 is between substantially 2.0 to 2.5 times the diameter $D_1$ of the mixing tube 38 or 138. The length $L_2$ of the flame tube 42 is at least twice the diameter $D_2$ of the flame tube. For example 2.5 times the diameter. This length is necessary to ensure that the flame, which is formed downstream of the mixing tube 38 or 138 contacts the inside wall of the flame tube upstream of the open end of the flame tube. In this way the flame front closes the open end of the flame tube. This is the requirement for stable recirculation of combustion gases outside the mixing tube from the downstream end of the mixing tube 38 or 138 to the upstream end thereof. Recirculation of combustion gases is further promoted in that air flowing through the aperture 36 produces a reduced pressure in the passage 35 (FIG. 1) and in the perforations in the upstream portion of each form of mixing tube 138 (FIG. 2) which draws in combustion gases being recirculated outside the mixing tube. In order not to hamper recirculation of combustion gases, it is necessary that the cross-section of the air stream through the aperture 36 should be less than the diameter $D_1$ of the mixing tube 38 or 138. This is achieved by making the diameter $D_3$ of the aperture 36 equal to or less than the diameter $D_1$ of the mixing tube 38 or 138. The wall 34 produces a contraction of the air stream behind the aperture 36, so that when the aperture 36 and the mixing tube 38 or 138 have approximately equal diameters, the diameter of the flow cross-section of the air stream flowing through the aperture 36 will be smaller than the diameter $D_1$ of the mixing tube. It follows, therefore, that when the aperture 36 has a diameter smaller than the diameter $D_1$, the diameter of the air stream will be smaller than the diameter $D_1$ of the mixing tube.

The burner 2 shown in FIGS. 1 and 2 also has an ionization probe 44 which protrudes into the flame tube as far as the flame zone and is connected in known manner to a control device 46, by which, when the flame is extinguished, the oil delivery is cut off by closing the shut-off valve 18 and switching off the motor 12.

In the embodiment shown in FIG. 1, the peripheral wall of the mixing tube 38 is perforated along a portion 37 of its length upstream from the downstream end 39 of the mixing tube. The remaining portion of the peripheral wall of the mixing tube 38 which has a length $L_o$ is unperforated. The length $L_o$ of the unperforated portion is less than two thirds of the diameter $D_1$ of the mixing tube. In principle, the mixing tube 38 could be perforated along the whole length of the peripheral wall. However, tests have shown that, in the course of time, when using a mixing tube perforated along its whole length, soot is deposited in the portion adjacent to the radial passage 35. This soot deposition can be avoided by providing the mixing tube with the unperforated portion having the length $L_o$.

As shown in FIG. 2, each form of mixing tube 138 extends from the wall 34 and has perforations in the upstream portion of the peripheral wall, as hereinbefore described, the perforated upstream portion having a length $L_4$ and being adjacent the wall 34. The perforations in the upstream portion provide communication from the space between the flame tube 42 and the mixing tube 138 into the interior of the mixing tube 138 and permit part of the combustion gases to be drawn into the mixing tube 138 for recirculation. The perforations in the upstream portion are therefore equivalent to the passage 35 described with reference to FIG. 1. Each form of mixing tube 138 shown in FIG. 2, has a portion of its peripheral wall perforated along a length from the downstream end thereof in a similar manner to the perforated portion 37 in the mixing tube 38 described with reference to FIG. 1. In addition, each form of mixing tube 138 has a further portion of its peripheral wall, adjacent to and downstream from the perforated upstream portion, unperforated corresponding to the unperforated portion of the mixing tube 38, described with reference to FIG. 1. The unperforated portion of the mixing tube 138 has a length $L_o$ which is less than two thirds of the diameter $D_1$ of the mixing tube 138.

The mixing tube 138 in the form shown below the horizontal centre line in FIG. 2 is cylindrical in cross-section throughout its length; whereas the upstream portion 139 of the mixing tube 138 shown above the horizontal centre line is conical and convergent away from the wall 34. The cone angle of the conical upstream portion 139 in the form shown in 90°, although other cone angles may be employed. The sum of the area of the perforations in the upstream portion of each form of mixing tube 138 is such as to permit a sufficient part of the combustion gases to be recirculated.

When using a known mixing tube which is unperforated throughout its whole length, optimum combustion conditions would result where the total length $L_1+L_4$ of the mixing tube is approximately 1.4 to 2.5 times its diameter. However, when using a perforated mixing tube 38 or 138, as hereinbefore described in accordance with this invention, it is expedient to make the length $L_1$ of the mixing tube approximately 60% to 80% greater than in a mixing tube which is not provided with perforations in the length $L_1$.

Good results are achieved by using a mixing tube 38 or 138 having a diameter $D_1$ of 35 mm. and a downstream portion of its peripheral wall perforated, as hereinbefore described, with circular holes each of a diameter of 2 mm., the space between adjacent holes being 4 mm.. The diameter of the circular holes may be varied between 4% and 10% of the diameter of the mixing tube 38 or 138 at its downstream end. The proportion of the sum of the area of the perforations is chosen so that gas oscillations occurring transversely to the axis of the flame tube 42 can pass through the perforations into the mixing tube 38 or 138; but the mixing tube acts substantially as an unperforated tube with respect to the air stream flowing through the aperture 36 and the oil discharged from the nozzle 6 and passing through the aperture 36. In order for the mixing tube 38 or 138 to act substantially as an unperforated tube, the proportion of the sum of the areas of the perforations in the downstream portion is between 20% and 50% of the total surface area of the downstream portion. The mixing tube 38 or 138 has a specified radiating surface area in order to ensure vaporisation of the oil before it enters the flame zone, the radiating surface area additionally determining the porportion of the area of the perforations.

Referring again to FIGS. 1 and 2, the flame tube 42 adjacent the downstream end 39 of the mixing tube 38, 138 is provided with a plurality of holes 43 which contribute to a reduction in the emission of noise. Preferably, with a flame tube of 75 mm. diameter, six to eight holes each having a diameter of between 8 to 10 mm. are spaced around the circumference of the flame tube.

With an oil burner according to the present invention, a substantial reduction of noise, particularly with frequencies below 500 Hz which are considered to be the most annoying, is achieved. By using an oil burner having a perforated mixing tube, as hereinbefore described, it is possible, as compared to using an oil burner having a known unperforated mixing tube, to reduce the noise level by 4 dBA at 1 m. in front of the burner and 1 m. above the floor in the boiler room in which a boiler fitted with the oil burner is installed.

A reduction of noise can also be obtained by forming a plurality of separate air openings arranged in a circle around a central opening in the wall 34 instead of providing the single aperture 36 in the wall 34, each of the plurality of openings being smaller than the single aperture 36. The plurality of air openings leads to an increase of the area of the air stream flowing into the mixing tube, and thereby to a more favourable oscillation behaviour of the air. Such an arrangement is shown in FIG. 3. In FIG. 3, a central opening 135 is formed in the wall 34, oil being discharged into the mixing tube 38 by the nozzle 6 through the opening 135. A plurality of separate air openings 137 are formed in the wall 34 and are arranged in a circle around the central opening 135. The circle of openings 137 is positioned within an upstream projection of the internal cross-section of the mixing tube 38 on the wall 34. In FIG. 3, two different types of separate air openings 137 are shown, the openings 137 to the right of a vertical centre line having a circular cross-section, and the openings 137 to the left of the vertical centre line being longer in a direction radially of the mixing tube than in the circumferential direction thereof. Instead of the openings 137, to the left of the vertical centre line, being of the cross-sectional shape shown, the openings may alternatively be substantially trapezoidal in cross-section. The cross-sections of the openings 137 to the left of the vertical centre line give a greater total cross-section within the limited area available than the openings 137 of circular cross-section.

The openings 137, instead of being arranged on a common pitch circle as in FIG. 3, may alternatively be arranged on two common pitch circles as shown in FIG. 4. In FIG. 4, the openings 137 are of circular cross-section and alternate openings 137 are arranged on different pitch circles.

By using an oil burner having only a plurality of separate openings 137 and a central opening 135 in the wall 34, instead of using an oil burner having a single aperture 36 in the wall, the mixing tube being unperforated in each case, it is possible to reduce the noise level by approximately 4.5 dBA in the flue pipe behind the oil burner and by approximately 3 dBA at 1 m. in front of the burner and 1 m. above the floor in the boiler room, in which the boiler fitted with the oil burner is installed.

Tests have shown that the provision of the perforated mixing tube in accordance with this invention and the plurality of openings 137 and the central opening 135 in the wall 34 act cumulatively, and therefore good noise reduction results are achieved by employing them together in an oil burner. Thus, reductions in noise level of approximately 6 dBA in the flue pipe behind the oil burner and of approximately 5 dBA at 1 m. in front of the burner and 1 m. above the floor in the boiler room can be achieved.

What is claimed is:

1. An oil burner, comprising a chamber, an oil atomizing device supported in said chamber, an air supply duct connected to said chamber for delivering air to said chamber, a wall located in said chamber transversely to the axis thereof and positioned downstream of said atomizing device, said wall having at least one aperture formed therein through which oil from said atomizing device and air are discharged from said chamber, a substantially cylindrical flame tube joined to said wall and extending in an upstream direction therefrom, a mixing tube positioned coaxially within said flame tube downstream from and coaxial with the aperture in said wall, the portion of said mixing tube adjacent to the downstream end thereof being perforated and the portion of said mixing tube adjacent the upstream end thereof being imperforate, the imperforate portion of said mixing tube having an axial length that is more than $\frac{1}{3}$ but that is less than $\frac{2}{3}$ of the diameter of said mixing tube, said flame tube having a length that is at least twice the diameter thereof and a diameter between substantially 2.0 and 2.5 times the diameter of said mixing tube, and at least one passage being located adjacent to said wall and extending between the annular space between said flame tube and said mixing tube and the interior of said mixing tube, the upstream end of said mixing tube being spaced from said transverse wall to define said passage, said passage providing for recirculation of the combustion gases, and said perforations in said mixing tube enabling gases in said mixing tube to expand radially, whereby noises due to pressure variations in said flame tube are reduced.

2. An oil burner as claimed in claim 1 in which the sum of the area of the perforations in the portion of the peripheral wall adjacent the downstream end of said mixing tube is between 20% and 50% of the total surface area of said downstream end portion of the peripheral wall.

3. An oil burner as claimed in claim 2 in which the perforations in said downstream end portion of the peripheral wall of the mixing tube are circular holes each having a diameter of between 4% and 10% of the diameter of said perforated portion of said mixing tube.

4. An oil burner as claimed in claim 1 in which the aperture in said transverse wall is of circular cross-section and has a diameter not exceeding the diameter of said perforated portion of said mixing tube.

5. An oil burner comprising a chamber, an oil atomizing device supported in said chamber, an air supply duct connected to said chamber and through which duct air is delivered to said chamber, a wall extending transversely of said chamber and positioned downstream of said atomizing device, said wall having therein at least one aperture through which air and oil from said atomizing device are discharged from said chamber, a substantially cylindrical flame tube extending from said wall in the downstream direction, a mixing tube positioned coaxially within said flame tube downstream from and coaxial with the aperture in said wall, said mixing tube having a portion of its peripheral wall at least adjacent its downstream end thereof perforated, said flame tube having a length at least twice the diameter thereof and a diameter between substantially 2.0 and 2.5 times the diameter of said mixing tube, and at least one passage adjacent said wall, and extending between the annular space between said flame tube and said mixing tube and the interior of said mixing tube, said mixing tube extending from said transverse wall in the downstream direction and having a portion of its peripheral wall adjacent said transverse wall perforated to define a plurality of passages that extend from the annular space between said flame tube and said mixing tube into the interior of said mixing tube, the mixing tube having a further portion of its peripheral wall adjacent to and downstream from said portion adjacent the transverse wall that is unperforated, said further unperforated portion extending axially of said mixing tube for a length which is less than $\frac{2}{3}$ of the diameter of said perforate portion of said mixing tube, the perforated portion of said mixing tube adjacent its upstream end being conical and being convergent in the downstream direction.

6. An oil burner, comprising a chamber, an oil atomizing device supported in said chamber, an air supply duct connected to said chamber for delivering air under pressure to said chamber, a wall located in said chamber transversely to the axis thereof and positioned downstream of said atomizing device, said wall having at least one aperture formed therein through which oil from said atomizing device and air under pressure are discharged from said chamber, a substantially cylindrical flame tube joined to said wall and extending in an upstream direction therefrom, a mixing tube positioned coaxially within said flame tube downstream from and coaxial with the aperture in said wall, said flame tube having a length that is at least twice the diameter thereof and a diameter between substantially 2.0 and 2.5 times the diameter of said mixing tube, and at least one passage being located adjacent to said wall and extending between the annular space between said flame tube and said mixing tube and the interior of said mixing tube, the upstream end of said mixing tube being spaced from said transverse wall to define said passage, said passage providing for recirculation through said flame tube of the combustion gases that have been discharged therefrom, and said aperature in said transverse wall including a central opening and a plurality of openings smaller than said central openings and arranged in a substantially circular pattern around said central opening said plurality of openings being confined within an upstream projection of the internal circumference of said mixing tube on said transverse wall, the air under pressure as introduced into said chamber defining the only source of pressurized air for mixing with the oil as discharged from the atomizing device, said air under pressure in said chamber and atomized oil as mixed being discharged from said chamber and directed through said central opening and smaller openings arranged therearound, wherein unpressurized secondary air is prevented from entering said mixing tube, said secondary openings and said central opening through which the pressurized air is discharged cooperating to reduce noise emissions in said flame tube.

7. An oil burner as claimed in claim 6 in which said air openings are of circular cross-section.

8. An oil burner as claimed in claim 6 in which said air openings are longer in a direction radially of said mixing tube than in the circumferential direction thereof.

* * * * *

UNITED STATES PATENT AND TRADEMARK OFFICE

CERTIFICATE OF CORRECTION

PATENT NO. : 4,318,688

DATED : March 9, 1982

INVENTOR(S) : BUSCHULTE, Winfried, and DAGEFORDE, Friedhelm

It is certified that error appears in the above-identified patent and that said Letters Patent is hereby corrected as shown below:

Column 6, line 8, change "upstream" to --downstream--.

Column 7, line 22, change "upstream" to --downstream--.

Signed and Sealed this

*Twentieth* Day of *September 1983*

[SEAL]

*Attest:*

GERALD J. MOSSINGHOFF

*Attesting Officer*

*Commissioner of Patents and Trademarks*